US009857157B2

(12) United States Patent
Scheid et al.

(10) Patent No.: US 9,857,157 B2
(45) Date of Patent: Jan. 2, 2018

(54) STAND-OFF CHARGE SYSTEM INCLUDING AN ATTACHMENT BRACKET AND RELATED METHODS

(71) Applicant: The United States of America as represented by the Secretary of the Navy, Washington, DC (US)

(72) Inventors: Eric Scheid, Bloomington, IN (US); Brad Moan, Greenwood, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/237,674

(22) Filed: Aug. 16, 2016

(65) Prior Publication Data

US 2017/0052010 A1 Feb. 23, 2017

Related U.S. Application Data

(60) Provisional application No. 62/206,254, filed on Aug. 17, 2015.

(51) Int. Cl.
*F42D 1/00* (2006.01)
*F42B 1/02* (2006.01)

(52) U.S. Cl.
CPC . *F42D 1/00* (2013.01); *F42B 1/02* (2013.01)

(58) Field of Classification Search
CPC ..... F41D 1/00; F42B 1/02
USPC ..... 102/305
See application file for complete search history.

(56) References Cited

U.S. PATENT DOCUMENTS 2,757,611 A * 8/1956 Church ..... F42B 1/024 102/307
2,796,833 A * 6/1957 Sweetman ..... E21B 43/116 102/306
3,981,240 A * 9/1976 Gladden ..... F42B 3/18 102/202.4
4,109,576 A * 8/1978 Eckels ..... F42B 1/02 102/307
6,606,950 B1 * 8/2003 Putman ..... F41H 11/12 102/306

* cited by examiner

*Primary Examiner* — Joshua E Freeman
(74) *Attorney, Agent, or Firm* — Christopher A. Monsey

(57) ABSTRACT

Exemplary apparatus, systems, and methods to provide an ability to quickly and securely hand emplace stand-off demolition charges to various surfaces or structures including surfaces including any flat surface. An aspect of the embodiment of the invention is a lightweight attachment bracket that will hold charges at distances up to (e.g., ten inches) away from a vertical target. The bracket is collapsible, therefore provides a user adjustable stand-off, which is necessary for some applications. Attachment to ferrous material can be instant through a set of rare earth metals imbedded in the base of the bracket. A skirt of high strength textile material provides attachment to other surfaces via integrated hooks and rings. Alternative embodiments of the invention could include an electromagnetic system provided to couple the bracket with a battery in order to provide a limited amount of power to operate the system.

21 Claims, 4 Drawing Sheets

STAND-OFF CHARGE SYSTEM INCLUDING AN ATTACHMENT BRACKET AND RELATED METHODS

CROSS-REFERENCE TO RELATED APPLICATIONS

The present application claims priority to U.S. Provisional Patent Application Ser. No. 62/206,254, filed Aug. 17, 2015, entitled "STAND-OFF CHARGE ATTACHMENT BRACKET, SYSTEM, AND RELATED METHODS," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,273) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to various apparatus, systems, and methods to provide an ability to quickly and securely hand emplace stand-off demolition charges to various surfaces or structures including any flat surface. A stand-off charge includes any charge that is designed to detonate a short distance away from the target surface for optimal performance such as a shaped charge. A stand-off distance can include a predetermined distance comprising a distance of a section of plasma jet formed by the shaped charge comprising an end or another section of the plasma jet.

Hand emplaced demolition charges are typically placed in direct contact with an intended target surface. However, some applications require the use of stand-off charges. Stand-off charges require an air gap between the point of detonation and the target for optimal performance. When stand-off munitions are used, an attachment means can be impromptu and/or cumbersome as charge attachment methods do not account for the air space nor extra strength required to support a cantilevered load.

According to an illustrative embodiment of the present disclosure, an exemplary device can be a lightweight attachment bracket that will hold charges of seven or more pounds at distances up to ten inches away from a vertical target. The bracket is collapsible and therefore provides a user adjustable stand-off, which is necessary for some applications. Attachment to ferrous material can be instant via a set of rare earth magnets imbedded in the base of the bracket. A skirt of high strength textile material may provide attachment to other surfaces via integrated hooks and rings. Related methods are also provided.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1C:
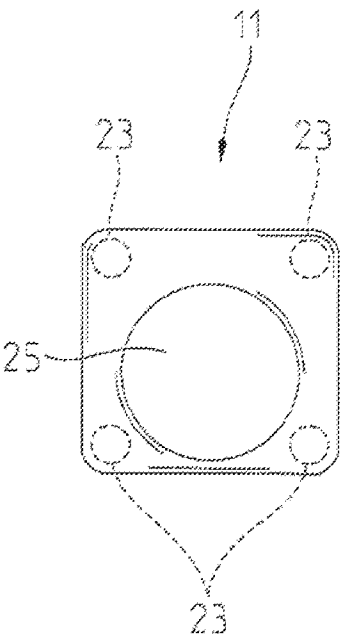
FIG. 1C shows a back view of an exemplary stand-off charge attachment bracket.
Figure 1A:
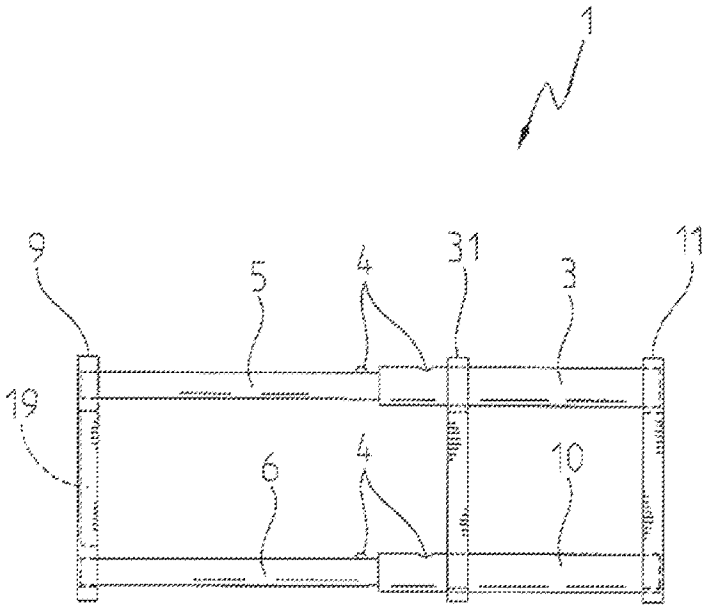
FIG. 1A shows a profile view of an exemplary stand-off charge attachment bracket.
Figure 1B:
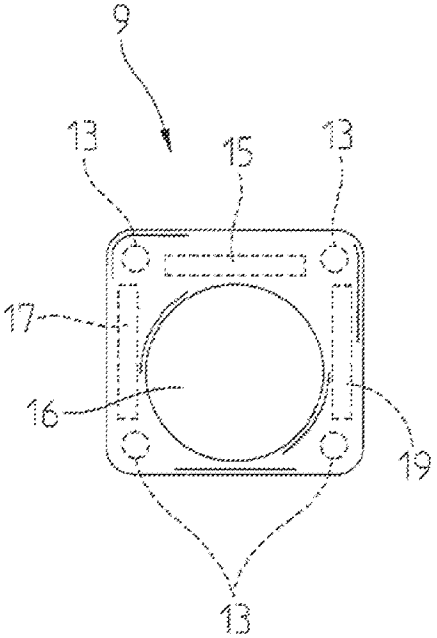
FIG. 1B shows a front view of an exemplary stand-off charge attachment bracket.

FIGS. 1A, 1B, and 1C show an exemplary stand-off charge attachment bracket 1. The exemplary stand-off charge attachment bracket 1 can be formed to be user adjustable and/or collapsible to minimize carrying size and to allow for adjustable stand-off distances. The exemplary stand-off charge attachment bracket 1 can be formed with a high strength plastic frame that is formed with a first 3, second 10, third 14 (not shown), and fourth 18 (not shown) frame section that couples with a first plate or end 9 around a first aperture 16 formed in or defined by edges or sides of the first plate or end 9. The first through fourth (3, 10, 14, 18) frame sections can be hollow and formed to respectively and insertably/slideably receive ends or portions of a fifth 5, sixth 6, seventh 8 (not shown), and eighth 20 (not shown) frame sections. The fifth 5, sixth 6, seventh 8 (not shown), and eighth 20 (not shown) frame sections can be coupled with a second plate or end 11 around a second aperture 25 formed in the second plate 11. The first plate 9 can be provided with or coupled to a set of high power or strength coupling structures (e.g., rare earth magnets 15, 17, 19) and a high strength textile skirt 41 disposed around the first aperture 16. The textile skirt 41 illustratively comprises integrated hooks and rings coupled to either the first or second plate section 9, 11, wherein the hooks and rings are configured to couple with a mounting surface. The first aperture 16 can be formed to accept insertion of a stand-off charge (e.g., shape charge) and have catches (not shown) in place to secure the stand-off charge to the stand-off-charge attachment bracket 1.

An illustrative locking structure 4 is adapted to lock or prevent movement of a first frame assembly comprising the first through fourth (3, 10, 14, 18) frame sections with respect to a second frame assembly comprising the fifth through eighth frame sections (5, 6, 8, 20) in order to ensure the stand-off charge remains in a fixed position with respect to a target location or mounting location to which the bracket 1 couples. The locking structure 4 can be a friction lock for a sliding portion of the bracket (e.g., first assembly with respect to the second assembly). The friction lock can be a threaded set screw with a knurled portion which is inserted into a threaded hole in a frame section which another frame section inserts into which applies pressure on the frame section which otherwise would insert into or extend from. An alternative embodiment can include a third plate 31 which can be attached to an opposing end of the fifth through eighth frame sections (5, 6, 8, 20), and an end the second plate is coupled with formed with a third aperture that the fifth through eighth frame sections (5, 6, 8, 20) coupled around in a spaced apart distance.

Figure 2:
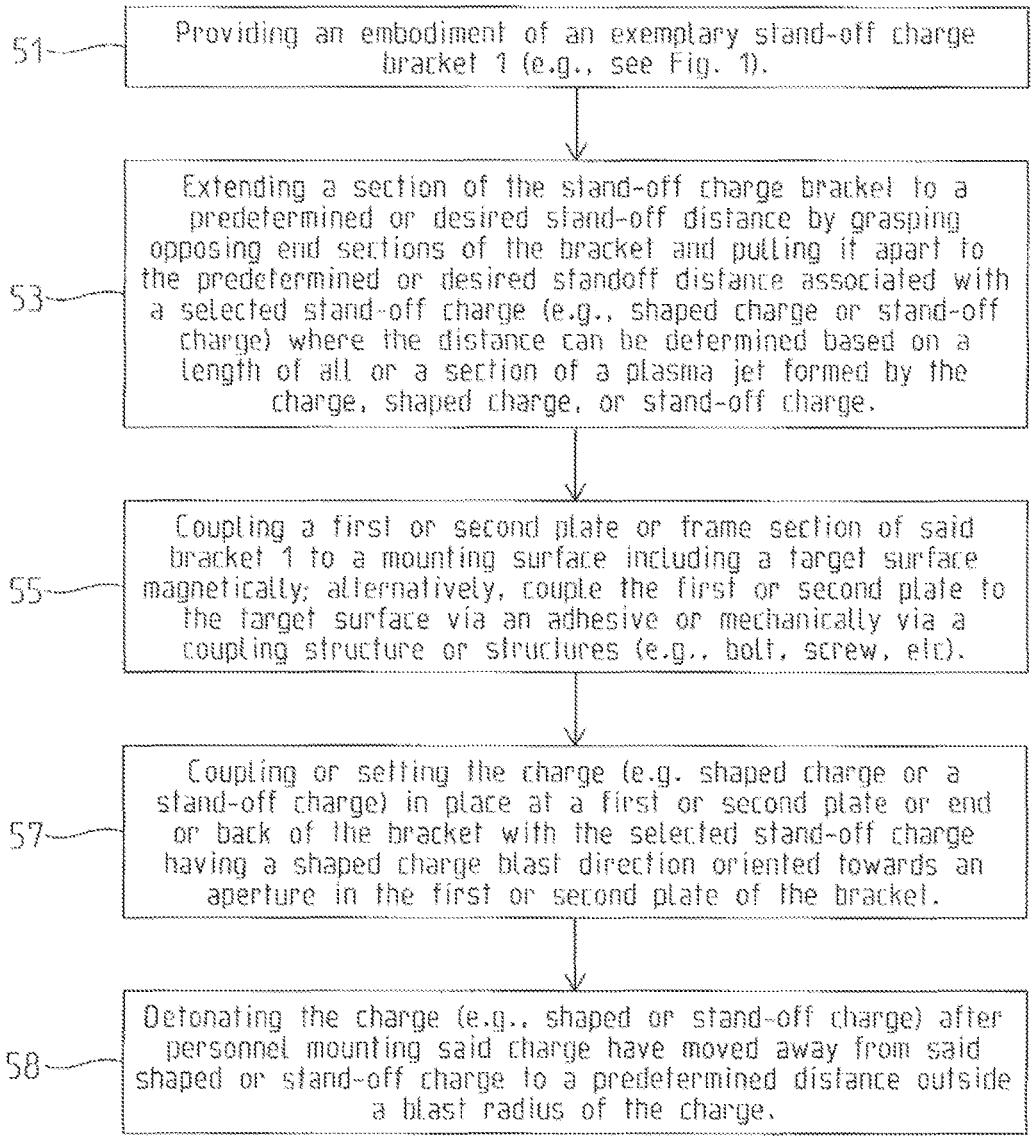
FIG. 2 shows an exemplary method of operation of an exemplary stand-off charge attachment bracket.

Referring to FIG. 2, one exemplary method of operation of an exemplary stand-off charge attachment bracket 1 is shown including five basic steps. At Step 51: providing an embodiment of an exemplary stand-off charge bracket 1 (e.g., see FIG. 1). At Step 53: extending a section of the standoff charge bracket to a predetermined or desired stand-off distance by grasping opposing end sections of the bracket and pulling it apart to the predetermined or desired standoff distance associated with a selected stand-off charge (e.g., shaped charge or stand-off charge) where the distance can be determined based on a length of all or a section of a plasma jet formed by the charge, shaped charge, or stand-off charge. At Step 55: Coupling a first or second plate or frame section of said bracket 1 to a mounting surface including a target surface magnetically; alternatively, couple the first or second plate to the target surface via an adhesive or mechanically via a coupling structure or structures (e.g., bolt, screw, etc.). At Step 57: coupling or setting the charge (e.g., shaped charge or a stand-off charge) in place at a first or second plate or end or back of the bracket with the selected stand-off charge having a shaped charge blast direction oriented towards an aperture in the first or second plate of the bracket. At Step 58: detonating the charge (e.g., shaped or stand-off charge) after personnel mounting said charge have moved away from said shaped or stand-off charge to a predetermined distance outside a blast radius of the charge.

Figure 3:
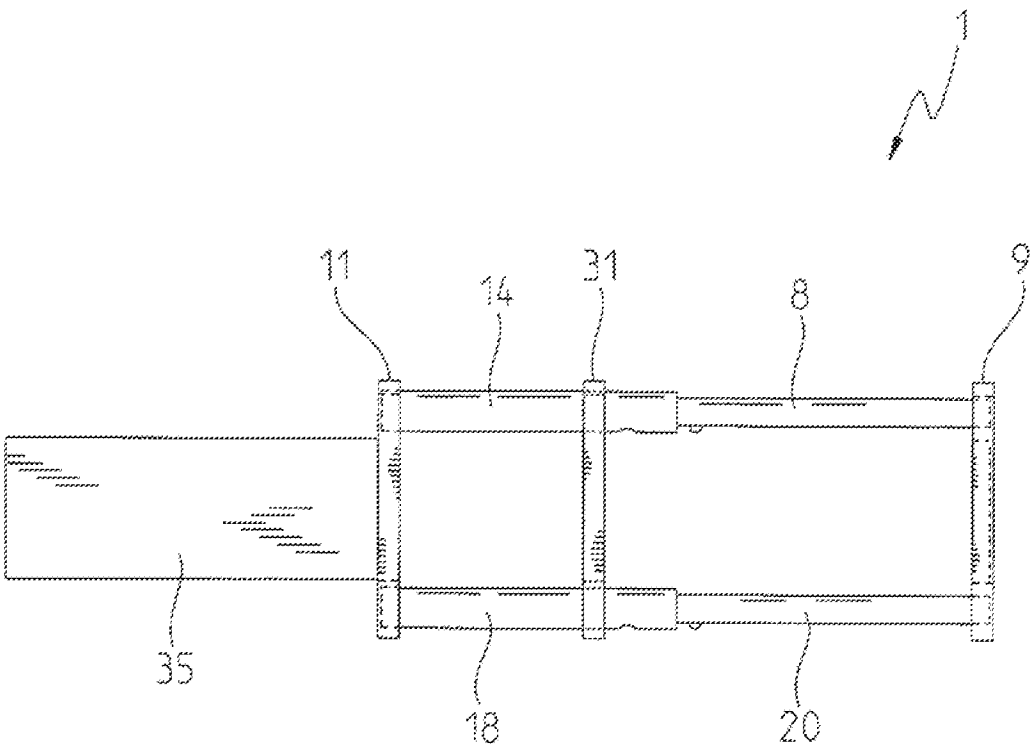
FIG. 3 shows an alternative profile view of an exemplary stand-off charge attachment bracket with an exemplary stand-off charge.

FIG. 3 shows an alternative view of an exemplary stand-off charge bracket 1 as shown in FIG. 1. The third 14, fourth 18, seventh 8, and eighth 20 frame sections are shown in relation to first 9, second 11, and third 31 plates. A stand-off charge 35 is shown prior to insertion into stand-off charge bracket 1.

Figure 4:
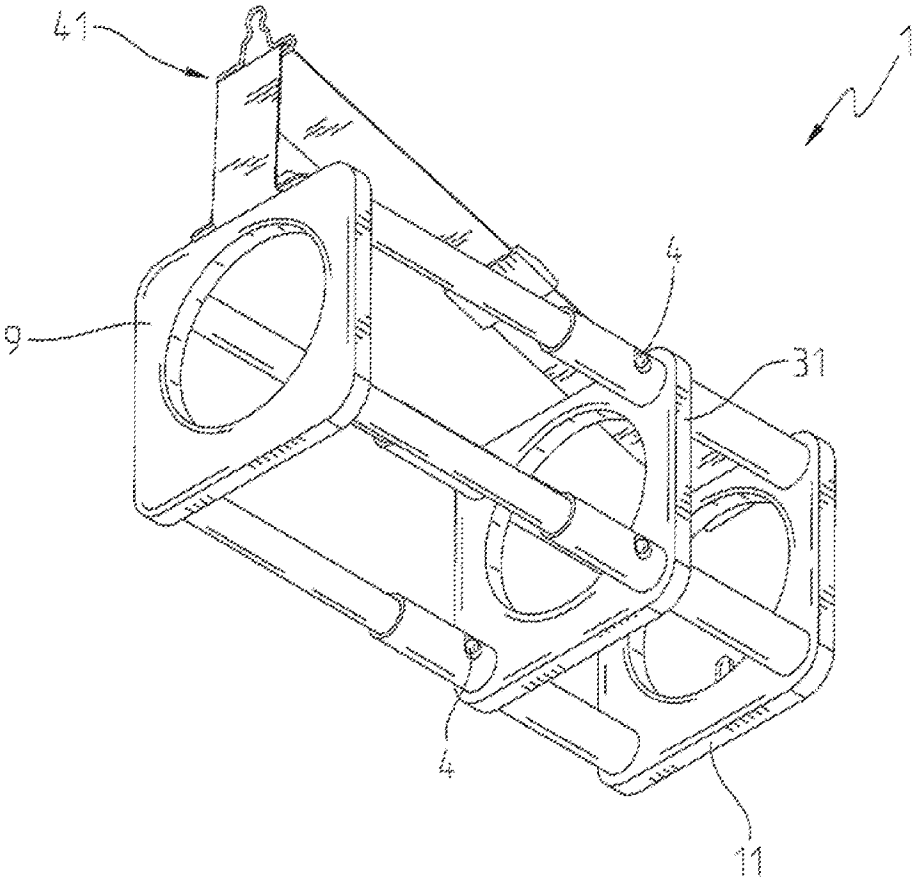
FIG. 4 shows a perspective view of an exemplary stand-off charge attachment bracket with a textile strap.

FIG. 4 shows a perspective view of an exemplary stand-off charge bracket 1 with a textile strap 41, first 9, second 11, and third 31 plates, and locking mechanism 4.

Although the invention has been described in detail with reference to certain preferred embodiments, variations and modification exist within the spirit and scope of the invention as described and defined in the following claims.

The invention claimed is:

1. An adjustable stand-off charge system including a mounting or attachment bracket apparatus comprising:

a first frame assembly comprising a first plate or frame section formed with a first aperture as well as a first, second, third, and fourth elongated frame sections, said first, second, third, and fourth elongated frame sections each comprising a first and second opposing end, said first ends of said first through fourth elongated frame sections are perpendicularly coupled or attached with one side of said first plate section at spaced apart sections of said first plate around said first aperture;

a second frame assembly comprising a second plate or frame section formed with a second aperture as well as a fifth, sixth, seventh, and eighth elongated frame sections, said fifth, sixth, seventh, and eighth elongated frame sections each comprising a third and fourth opposing end, said third ends of said fifth through eight elongated frame sections are perpendicularly coupled or attached with one side of said second plate section at spaced apart sections of said second plate around said second aperture;

a locking structure disposed in, formed into, or positioned with respect to said first frame assembly configured to selectively lock said first frame assembly with respect to motion or movement by said second frame assembly;

a plurality of first coupling structures formed into or attached with said first or second plate section disposed around either said first or second aperture, wherein said plurality of first coupling structures are configured to provide a coupling or attaching force sufficient to prevent said bracket with a stand-off charge coupled to said bracket from moving relative to a mounting surface including a target surface caused by a first force, wherein said first force comprises a gravitational force equal at least to a weight of said bracket and said stand-off charge;

a textile skirt comprising integrated hooks and rings coupled to either said first or second plate section, wherein said textile skirt is further configured to couple or attach with sections of said mounting surface; and a plurality of second coupling structures adapted to couple with or receive insertion of said stand-off charge configured to secure said stand-off charge comprising a shaped charge, wherein said plurality of second coupling structures are positioned on said first or second frame assemblies to orient said stand-off charge to direct a blast force direction generated by said stand-off charge into a center section of either said first or second aperture;

wherein said first, second, third and fourth elongated frame sections are hollow and formed to slideably receive a portion of said fifth, sixth, seventh, and eighth elongated frame sections.

2. An apparatus as in claim 1, further comprising a third plate formed with a third aperture, wherein said third plate is perpendicularly coupled to respective sections adjacent to opposing ends of said fifth through eighth elongated frame sections from said second plate around said third aperture.

3. An apparatus as in claim 1, wherein said plurality of first coupling structures comprise rare earth magnets.

4. An apparatus as in claim 1, wherein said plurality of first coupling structures comprise mechanical latches, suction structures, or mechanical engagement members configured to mechanically engage with and maintain relative position with said mounting surface.

5. An apparatus as in claim 1, wherein said plurality of first coupling structures comprise adhesives.

6. An apparatus as in claim 1, further comprising said stand-off charge coupled to said bracket.

7. A method of operating an exemplary stand-off charge system including an attachment bracket comprising:

providing an adjustable stand-off charge mounting or attachment bracket apparatus comprising:

a first frame assembly comprising a first plate or frame section formed with a first aperture as well as a first, second, third, and fourth elongated frame sections, said first, second, third, and fourth elongated frame sections each comprising a first and second opposing end, said first ends of said first through fourth elongated frame sections are perpendicularly coupled or attached with one side of said first plate section at spaced apart sections of said first plate around said first aperture;

a second frame assembly comprising a second plate or frame section formed with a second aperture as well as a fifth, sixth, seventh, and eighth elongated frame sections, said fifth, sixth, seventh, and eighth elongated frame sections each comprising a third and fourth opposing end, said third ends of said fifth through eight elongated frame sections are perpendicularly coupled or attached with one side of said second plate section at spaced apart sections of said second plate around said second aperture;

a locking structure disposed in, formed into, or positioned with respect to said first frame assembly configured to selectively lock said first frame assembly with respect to motion or movement by said second frame assembly;

a plurality of first coupling structures formed into or attached with said first or second plate section disposed around either said first or second aperture, wherein said plurality of first coupling structures are configured to provide a coupling or attaching force sufficient to prevent said bracket and a stand-off charge coupled to said bracket from moving relative to a mounting surface including a target surface caused by a first force, wherein said first force comprises a gravitational force equal to a weight of said bracket and said stand-off charge;

a textile skirt comprising integrated hooks and rings coupled to either said first or second plate section, wherein said hooks and rings are configured to couple with said mounting surface; and a plurality of second coupling structures adapted to couple with or receive insertion of a stand-off charge configured to secure said stand-off charge comprising a shaped charge, wherein said plurality of second coupling structures are positioned or disposed on said first or second frame assemblies to orient said stand-off charge to direct a blast force direction generated by said stand-off charge into a center section of either said first or second aperture;

wherein said first, second, third and fourth elongated frame sections are hollow and formed to slideably receive a portion of said fifth, sixth, seventh, and eighth elongated frame sections;

extending either said first or second frame assemblies from each other to a predetermined stand-off distance associated with the stand-off charge;

coupling said first or second plate or end of said bracket to said mounting surface with said plurality of first coupling structures;

coupling or disposing the stand-off charge at said first plate or end with a blast or shaped charge direction oriented towards the second in the second plate of the bracket;

detonating said shaped or stand-off charge after personnel mounting said charge have moved away from said shaped or stand-off charge.

8. A method as in claim 7, wherein said stand-off charge comprises a shaped charge.

9. A method as in claim 8, wherein said predetermined distance comprises a distance of a section of plasma jet formed by said shaped charge comprising an end of said plasma jet.

10. A method as in claim 7, further comprising a third plate formed with a third aperture, wherein said third plate is perpendicularly coupled to respective sections adjacent to opposing ends of said fifth through eighth elongated frame sections from said second plate around said third aperture.

11. A method as in claim 7, wherein said plurality of first coupling structures comprise rare earth magnets.

12. A method as in claim 7, wherein said plurality of first coupling structures comprise mechanical latches, suction structures, or mechanical engagement members configured to mechanically engage with and maintain relative position with said mounting surface.

13. A method as in claim 7, wherein said plurality of first coupling structures comprise adhesives.

14. A method associated with an exemplary stand-off charge system including an attachment bracket comprising:

manufacturing or assembling an adjustable stand-off charge mounting or attachment bracket apparatus comprising:

a first frame assembly comprising a first plate or frame section formed with a first aperture as well as a first, second, third, and fourth elongated frame sections, said first, second, third, and fourth elongated frame sections each comprising a first and second opposing end, said first ends of said first through fourth elongated frame sections are perpendicularly coupled or attached with one side of said first plate section at spaced apart sections of said first plate around said first aperture;

a second frame assembly comprising a second plate or frame section formed with a second aperture as well as a fifth, sixth, seventh, and eighth elongated frame sections, said fifth, sixth, seventh, and eighth elongated frame sections each comprising a third and fourth opposing end, said third ends of said fifth through eight elongated frame sections are perpendicularly coupled or attached with one side of said second plate section at spaced apart sections of said second plate around said second aperture;

a locking structure disposed in, formed into, or positioned with respect to said first frame assembly configured to selectively lock said first frame assembly with respect to motion or movement by said second frame assembly;

a plurality of first coupling structures formed into or attached with said first or second plate section disposed around either said first or second aperture, wherein said plurality of first coupling structures are configured to provide a coupling or attaching force sufficient to prevent said bracket and a stand-off charge coupled to said bracket from moving relative to a mounting surface including a target surface caused by a first force, wherein said first force comprises a gravitational force equal to a weight of said bracket and said stand-off charge;

a textile skirt comprising integrated hooks and rings coupled to either said first or second plate section, wherein said hooks and rings are configured to couple with said mounting surface; and a plurality of second coupling structures adapted to couple with or receive insertion of a stand-off charge configured to secure said stand-off charge comprising a shaped charge, wherein said plurality of second coupling structures are positioned on said first or second frame assemblies to orient said stand-off charge to direct a blast force direction generated by said stand-off charge into a center section of either said first or second aperture;

wherein said first, second, third and fourth elongated frame sections are hollow and formed to slideably receive a portion of said fifth, sixth, seventh, and eighth elongated frame sections.

15. A method as in claim 14, further comprising:

identifying a location comprising said mounting surface to place the mounting or attachment bracket and said stand-off charge;

extending either said first or second frame assemblies from each other to said predetermined stand-off distance associated with the stand-off charge;

coupling said first or second plate or end of said bracket to said mounting surface with said plurality of first coupling structures;

coupling or disposing the stand-off charge at said first plate or end with a blast or shaped charge direction oriented towards the second in the second plate of the bracket;

detonating said shaped or stand-off charge after personnel mounting said charge have moved away from said shaped or stand-off charge.

16. A method as in claim 14, wherein said stand-off charge comprises a shaped charge.

17. A method as in claim 16, wherein said predetermined distance comprises a distance of a section of plasma jet formed by said shaped charge comprising an end of said plasma jet.

18. A method as in claim 14, further comprising a third plate formed with a third aperture, wherein said third plate is perpendicularly coupled to respective sections adjacent to opposing ends of said fifth through eighth elongated frame sections from said second plate around said third aperture.

19. A method as in claim 14, wherein said plurality of first coupling structures comprise rare earth magnets.

20. A method as in claim 14, wherein said plurality of first coupling structures comprise mechanical latches or engagement members configured to mechanically engage with and maintain relative position with said mounting surface.

21. A method as in claim 14, wherein said plurality of first coupling structures comprise adhesives.

* * * * *